US008060002B2

(12) United States Patent
Jeon et al.

(10) Patent No.: US 8,060,002 B2
(45) Date of Patent: Nov. 15, 2011

(54) DEVELOPER STORAGE DEVICE AND IMAGE FORMING APPARATUS HAVING THE SAME

(75) Inventors: In Cheol Jeon, Yongin-si (KR); Yong Sung Kim, Seoul (KR); Sung Gi Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 629 days.

(21) Appl. No.: 12/190,716

(22) Filed: Aug. 13, 2008

(65) Prior Publication Data

US 2009/0214277 A1 Aug. 27, 2009

(30) Foreign Application Priority Data

Feb. 21, 2008 (KR) ..... 10-2008-0015801

(51) Int. Cl.
*G03G 21/12* (2006.01)

(52) U.S. Cl. ..... 399/360

(58) Field of Classification Search ..... 399/35, 399/120, 358–360
See application file for complete search history.

(56) References Cited

U.S. PATENT DOCUMENTS

| | | | | |
|---|---|---|---|---|
| 4,427,756 | A | 1/1984 | Mayer et al. | |
| 5,539,502 | A | 7/1996 | Koshino et al. | |
| 5,649,264 | A | 7/1997 | Domon et al. | |
| 5,913,097 | A | 6/1999 | Nakano et al. | |
| 6,038,422 | A | 3/2000 | Loewel | |
| 2005/0158081 | A1 | 7/2005 | Tamura | |
| 2006/0018691 | A1 | 1/2006 | Baek et al. | |
| 2006/0120779 | A1* | 6/2006 | Uchihashi | 399/358 |
| 2006/0159497 | A1* | 7/2006 | Choi et al. | 399/358 |
| 2006/0233560 | A1 | 10/2006 | Harada et al. | |

FOREIGN PATENT DOCUMENTS

| | | |
|---|---|---|
| CN | 1967406 A | 5/2007 |
| EP | 1477868 | 11/2004 |
| JP | 2007-139905 | 6/2007 |
| JP | 2007-156253 | 6/2007 |
| JP | 2007-178947 | 7/2007 |

OTHER PUBLICATIONS

Russian Search Report issued Nov. 17, 2009 in RU Application No. 2008135209.

Russian Decision on Grant issued Jan. 29, 2010 in RU Application No. 2008135209/28.

(Continued)

*Primary Examiner* — Hoang Ngo
(74) *Attorney, Agent, or Firm* — Stanzione & Kim, LLP

(57) ABSTRACT

A developer storage device and an image forming apparatus having the same include a developer storage part including a first storage part and a second storage part having widths different from each other, and a first developer conveying member to convey a developer stored in the first storage part to the second storage part in a diagonal direction. The first developer conveying member includes conveying elements extended slantingly with respect to a width direction of the developer storage part. An angle between the conveying elements and the width direction of the developer storage part is determined depending on relative positions of the first storage part and the second storage part. Accordingly, the developer storage device can effectively convey a developer by designing the developer conveying member adequately for an overall shape or structure of the developer storage device.

33 Claims, 9 Drawing Sheets

OTHER PUBLICATIONS

Korean Search Report issued Jul. 31, 2009 in KR Application No. 2008-0015801.
Korean Notice of Submission of Opinion issued in KR Application No. 2008-0015801.
European Search Report issued Sep. 27, 2010 in EP Application No. 08168193.4.
Chinese Office Action issued by the Chinese Patent Office on Dec. 31, 2010 in CN Patent Application 200810214490.X.

* cited by examiner

DEVELOPER STORAGE DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 2008-0015801, filed on Feb. 21, 2008 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus having a developer storage device.

2. Description of the Related Art

A conventional image forming apparatus is an apparatus that prints an image on a printing medium according to an input image signal. An image forming apparatus is classified as a printer, a copying machine, a fax machine, a multi-function printer which has multiple functions of printing, scanning, copying and faxing, and the like.

A particular type of image forming apparatus, for example an electrophotographic type image forming apparatus, includes a photosensitive body, a laser scanning unit and a developing unit. The laser scanning unit scans light to the photosensitive body charged to a predetermined electric potential to form an electrostatic latent image on the surface of the photosensitive body. The developing unit supplies a developer to the electrostatic latent image to form a visible image.

The visible image formed on the photosensitive body is directly transferred onto a printing medium, or is transferred onto a printing medium via an intermediate transfer unit. The image transferred onto the printing medium is fused to the printing medium through a fusing process.

In the printing operation, the visible image on the photosensitive body is not totally transferred onto the printing medium or the intermediate transfer unit. A portion of the developer remains on the photosensitive body. The residual developer on the photosensitive body is removed by a cleaning device, and is stored in a waste developer storage container.

A new developer, which is to be supplied to the photosensitive body, is stored in the developing unit, and a waste developer collected from the photosensitive body is stored in the waste developer storage container. Thus, both the developing unit and the waste developer storage container correspond to a developer storage device.

In order to store a sufficient amount of developer, the developer storage device should have a large capacity. However, the large capacity of the developer storage device results in difficulty in manufacturing a compact image forming apparatus.

In this regard, the developer storage device is designed so that an inner space of the image forming apparatus can be utilized as efficiently as possible. That is, the shape and structure of the developer storage device are adequately determined, depending upon arrangement of other components in the image forming apparatus.

A developer conveying member may be mounted inside the developer storage device to convey the developer to a predetermined target position. In order to effectively convey the developer so as to be evenly loaded in the developer storage device, the developer conveying member should be designed adequately to correspond to the shape and structure of the developer storage device.

SUMMARY OF THE INVENTION

The present general inventive concept provides a developer storage device capable of effectively conveying a developer by use of a developer conveying member designed adequately to correspond to an overall shape or structure of the developer storage device.

The present general inventive concept also provides an image forming apparatus having the above-mentioned developer storage device.

Additional aspects and/or utilities of the general inventive concept will be set forth in part in the description which follows and, in part, will be obvious from the description, or may be learned by practice of the general inventive concept.

The foregoing and/or other aspect and utilities of the present general inventive concept are achieved by providing a developer storage device including a developer storage part including a first storage part and a second storage part having widths different from each other, and a first developer conveying member to convey a developer stored in the first storage part to the second storage part in a diagonal direction.

The first developer conveying member may include conveying elements extended slantingly with respect to a width direction of the developer storage part.

An angle between the conveying elements and the width direction of the developer storage part may be determined depending on relative positions of the first storage part and the second storage part.

The first developer conveying member may be sectioned into at least two parts in the width direction of the developer storage part, and the conveying elements may be arranged to have symmetry in the at least two parts.

The second storage part may be disposed at a biased position in the width direction with respect to the first storage part.

The first developer conveying member may be sectioned into at least two parts in the width direction of the developer storage part, and the conveying elements provided in one part of the first developer conveying member may include conveying elements extended slantingly at an angle larger than the conveying elements provided in the other part of the first developer conveying member with respect to the width direction of the developer storage part.

The first developer conveying member may further include an arrangement angle changing portion in which an angle of the conveying elements extended slantingly is changed.

The first developer conveying member may include a first conveying part to convey a developer to a center portion of the second storage part in a first direction, and a second conveying part to convey a developer to the center portion of the second storage part in a second direction.

The first conveying part and the second conveying part may be arranged parallel to each other in a width direction of the developer storage part.

The center portion of the second storage part may be located at a deviated position from a center portion of the first storage part in the width direction.

The first conveying part may convey the larger amount of developer than the second conveying part.

The first conveying part and the second conveying part may be arranged such that a boundary line therebetween is positioned near the center portion of the second storage part.

The second storage part may have a width smaller than the first storage part.

The developer storage part may store a waste developer.

The first developer conveying member may be formed in a plate shape, and may convey a developer by a reciprocating motion in the developer storage part.

The first developer conveying member may include a guide part to guide the motion thereof, and the guide part may be formed along a direction in which a developer is to be conveyed.

The conveying elements may include conveying ribs arranged apart from each other in a developer conveying direction.

Each of the conveying ribs may include slanted surfaces which are slanted with respect to the developer conveying direction.

Each of the conveying ribs may include a vertical surface directed in the developer conveying direction and a slanted surface positioned opposite to the vertical surface.

The developer storage part may further include a third storage part to store a developer to be conveyed to the first storage part, and a developer path to connect the third storage part and the first storage part.

A part of the first developer conveying member may be disposed in the developer path.

The developer storage device may further include a second developer conveying member disposed in the third storage part.

The first developer conveying member may be operated interlockingly with the second developer conveying member.

The second developer conveying member may perform a rotating motion, and the first developer conveying member may perform a rectilinear motion.

The foregoing and/or other aspects and utilities of the present general inventive concept may also be achieved by providing an image forming apparatus including an image carrier, and a developer storage device to store a new developer to be supplied to the image carrier or a waste developer collected from the image carrier. The developer storage device may include a developer storage part including a first storage part and a second storage part having widths different from each other, and a developer conveying member to convey a developer stored in the first storage part to the second storage part by a reciprocating motion in the developer storage part. The developer conveying member may include conveying ribs extended in a diagonal direction with respect to a width direction of the developer storage part.

The developer conveying member may be sectioned into a first part and a second part in the width direction of the developer storage part.

The conveying ribs provided in the first part and the conveying ribs provided in the second part may be arranged to have symmetry to each other.

The first storage part and the second storage part may be arranged such that a center portion of the second storage part is located at a deviated position from a center portion of the first storage part in the width direction.

The conveying ribs may be arranged in the first part and the second part so as to convey a developer to the center portion of the second storage part in different directions from each other, and an angle (θ3, which is an acute angle) between at least some of the conveying ribs arranged in the first part and the width direction of the developer storage part may be larger than an angle (θ4, which is an acute angle) between the conveying ribs arranged in the second part and the width direction of the developer storage part.

The foregoing and/or other aspects and utilities of the present general inventive concept may also be achieved by providing a developer conveying member usable with a developer storage device, including first and second conveying parts disposed adjacent to each other in a direction, and having first and second ribs disposed in first and second directions having an angle with the direction with convey the developer.

The developer conveying member may further include third and fourth conveying parts having narrower widths than the first and second conveying parts to convey the developer to the first and second conveying parts.

The foregoing and/or other aspects and utilities of the present general inventive concept may also be achieved by providing a developer storage device, including a main frame and a developer conveying member disposed in the main frame, and including first and second conveying parts disposed adjacent to each other in a direction, and having first and second ribs disposed in first and second directions having an angle with the direction with convey the developer.

The developer storage device may further include third and fourth conveying parts having narrower widths than the first and second conveying parts to convey the developer to the first and second conveying parts.

The developer storage device may further include a light transmitting hole formed on the main frame between the third and fourth conveying parts.

The foregoing and/or other aspects and utilities of the present general inventive concept may also be achieved by providing a image forming apparatus, including a developer storage device comprising a plurality of developer storage parts, such that a waste developer is accumulated in a first of the plurality of developer storage parts before accumulating in a second of the plurality of the developer storage parts, and a conveying member to first convey the waste developer from the another of the plurality of the developer storage parts to the first of the plurality of developer storage parts.

The plurality of developer storage parts may each have differing widths.

The width of the first developer storage part may be smaller than the width of the second developer storage part.

The conveying member may move in a reciprocating motion with respect to the first of the plurality of developer storage parts to transfer the developer thereto.

The conveying member may include a plurality of conveying ribs extended in a diagonal direction with respect to a width direction of the developer storage device.

The plurality of conveying ribs may be divided by a center portion of the conveying member to extend a first portion of the plurality of conveying ribs in a first diagonal direction and to extend a second portion of the plurality of conveying ribs in a second diagonal direction.

An angle of the first portion of the plurality of conveying ribs with respect to the center portion of the conveying member may decrease as the first portion of the plurality of conveying ribs move away from the center portion of the conveying member.

The foregoing and/or other aspects and utilities of the present general inventive concept may also be achieved by providing an image forming apparatus, including a plurality of developer storage parts to store waste developer therein, and a conveying member to convey the waste developer a first of the plurality of developer storage parts to another of the plurality of the developer storage parts, the conveying member including a plurality of conveying ribs extending from a center portion of the conveying member at acute angles to convey the waste developer from, and an arrangement angle changing portion to decrease the acute angles of the conveying ribs as the conveying ribs move away from the center portion of the conveying member.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
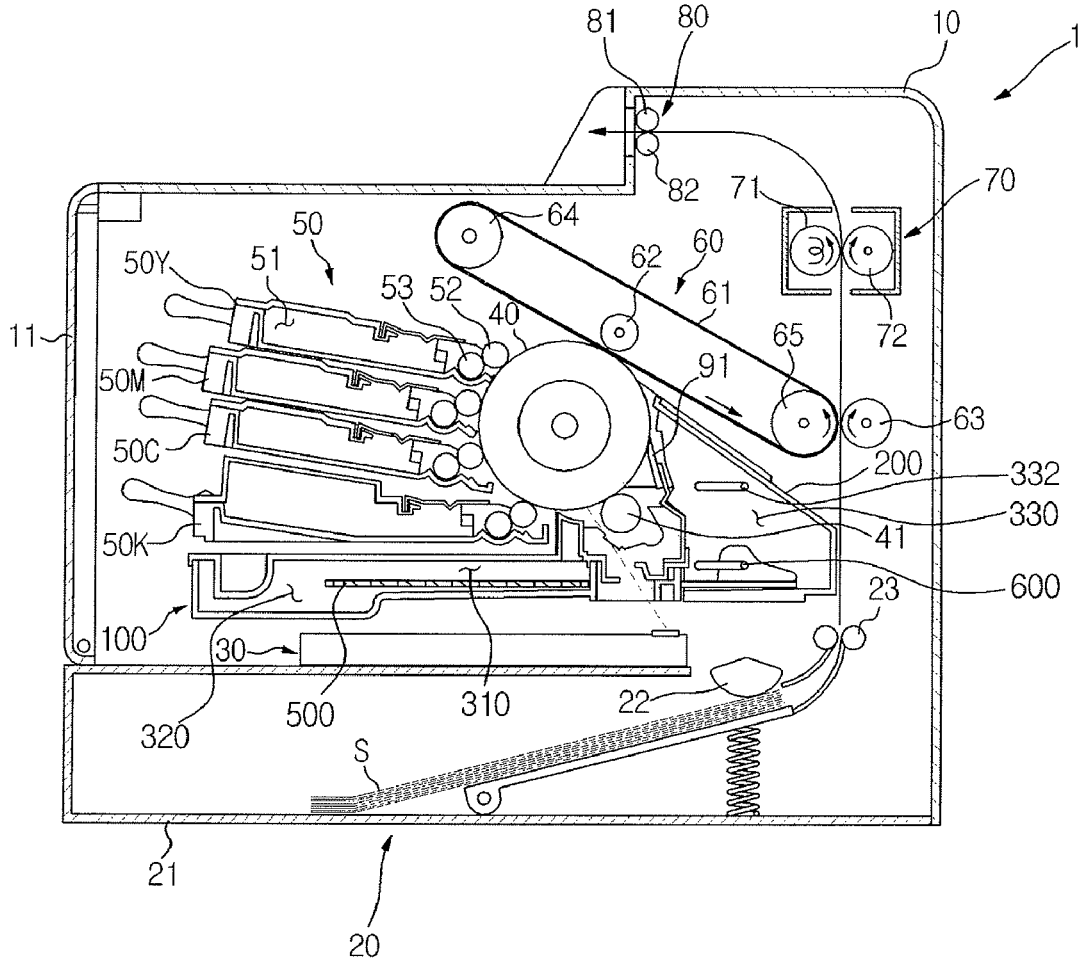
FIG. 1 is a view illustrating a constitution of an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a view illustrating a constitution of an image forming apparatus 1 according to an exemplary embodiment of the present general inventive concept. As illustrated in FIG. 1, the image forming apparatus 1 includes a main body 10, a printing medium feeding unit 20, a laser scanning unit 30, a photosensitive body 40, a developer storage device 100, a developing unit 50, a transfer unit 60, a fusing unit 70 and a printing medium discharge unit 80.

The main body 10 forms an exterior appearance of the image forming apparatus 1, and supports components mounted thereinside. A cover 11 is hingedly coupled to the main body 10 to expose or shield an opened portion of the main body 10.

The printing medium feeding unit 20 serves to feed a printing medium S toward the transfer unit 60. The printing medium feeding unit 20 includes a cassette 21 to store the printing medium S, a pickup roller 22 to pick up the printing medium S in the cassette 21 sheet by sheet, and a feeding roller 23 to feed the picked-up printing medium S toward the transfer unit 60.

The laser scanning unit 30 is disposed below the developer storage device 100, and scans light corresponding to image information to the photosensitive body 40 to form an electrostatic latent image on a surface of the photosensitive body 40.

The photosensitive body 40 serves as an image carrier whereupon an electrostatic latent image is formed by the laser scanning unit 30 and a developer image formed by the developing unit 50.

The photosensitive body 40 is rotatably mounted in a housing 200. The housing 200 is removably mounted in the main body 10. Also, a charging roller 41 is mounted in the housing 200. The photosensitive body 40 is charged to a predetermined electric potential by the charging roller 41 before the laser scanning unit 30 scans light to the photosensitive body 40.

After the developing and transfer processes of one cycle are completed, a residual developer on the surface of the photosensitive body 40 is collected and stored in the developer storage device 100. The developer storage device 100 is formed integrally with the housing 200. The detailed explanation of the constitution of the developer storage device 100 will be made later.

The developing unit 50 supplies the developer to the photosensitive body 40, on which the electrostatic latent image is formed, to develop the electrostatic latent image into a visible image. The developing unit 50 includes four developing devices 50Y, 50M, 50C and 50K, in which developers of different colors, e.g., yellow (Y), magenta (M), cyan (C) and black (K), are respectively stored.

Each of the developing devices 50Y, 50M, 50C and 50K includes a developer storage part 51, a supply roller 52 and a developing roller 53. The developer storage part 51 stores a developer to be supplied to the photosensitive body 40. The supply roller 52 supplies the developer stored in the developer storage part 51 to the developing roller 53. The developing roller 53 attaches the developer to the surface of the photosensitive body 40, on which the electrostatic latent image is formed, to form a visible image.

The transfer unit 60 includes an intermediate transfer belt 61, a first transfer roller 62 and a second transfer roller 63.

The intermediate transfer belt 61 serves as an image carrier which holds a visible image formed by the developing unit 50.

The intermediate transfer belt 61 is supported by support rollers 64 and 65, and may operate at the same velocity as a linear velocity of the photosensitive body 40. The first transfer roller 62 opposes the photosensitive body 40, and the intermediate transfer belt 61 is interposed between the first transfer roller 62 and the photosensitive body 40 to transfer the visible image formed on the photosensitive body 40 onto the intermediate transfer belt 61.

The second transfer roller 63 opposes the support roller 65, and the intermediate transfer belt 61 is interposed between the second transfer roller 63 and the support roller 65. When the image is transferred onto the intermediate transfer belt 61 from the photosensitive body 40, the second transfer roller 63 may be spaced apart from the intermediate transfer belt 61. When the image is completely transferred onto the intermediate transfer belt 61 from the photosensitive body 40, the second transfer roller 63 comes into contact with the intermediate transfer belt 61 with a predetermined pressure. When the second transfer roller 63 contacts the intermediate transfer belt 61, the image on the intermediate transfer belt 61 is transferred onto the printing medium S.

The fusing unit 70 includes a heating roller 71 having a heat source, and a press roller 72 mounted in opposition to the heating roller 71. When the printing medium S passes between the heating roller 71 and the press roller 72, the image is fused to the printing medium by heat transferred from the heating roller 71 and pressure exerted between the heating roller 71 and the press roller 72.

The printing medium discharge unit 80 includes a discharge roller 81 and a discharge backup roller 82 in order to discharge the printing medium S having passed through the fusing unit 70 to the outside of the main body 10.

The operation of the above-constituted image forming apparatus 1 will now be explained. At the beginning of the printing operation, the surface of the photosensitive body 40 is uniformly charged by the charging roller 41. The laser scanning unit 30 irradiates light corresponding to image information of any one color, e.g., yellow, to the uniformly charged surface of the photosensitive body 40, and an electrostatic latent image corresponding to the yellow image is formed on the photosensitive body 40.

A developing bias is applied to the developing roller 53 of the yellow developing device 50Y, and the yellow developer is attached to the electrostatic latent image. The electrostatic latent image is developed into a yellow visible image on the photosensitive body 40. The visible image is transferred onto the intermediate transfer belt 61 by the first transfer roller 62.

If the yellow visible image corresponding to one page is completely transferred, the laser scanning unit 30 scans light corresponding to image information of another color, e.g., magenta, to the photosensitive body 40 to form an electrostatic latent image corresponding to the magenta image. The magenta developing device 50M supplies the magenta developer to the electrostatic latent image to develop the electrostatic latent image into a magenta visible image. The magenta visible image formed on the photosensitive body 40 is transferred onto the intermediate transfer belt 61 by the first transfer roller 62, and is overlapped with the yellow visible image which has been already transferred.

Thereafter, if the visible images of cyan and black are sequentially transferred onto the intermediate transfer belt 61 through the same procedures as above, a color visible image is formed on the intermediate transfer belt 61 by the overlapped yellow, magenta, cyan and black images. The color visible image is transferred onto the printing medium S as it passes between the intermediate transfer belt 61 and the second transfer roller 63. Then, the printing medium S is discharged to the outside of the main body 10 via the fusing unit 70 and the printing medium discharge unit 80.

In the above image forming process, when the image on the photosensitive body 40 is transferred onto the intermediate transfer belt 61, a portion of the developer remains on the photosensitive body 40. In order to perform the developing and transfer processes of the next cycle, the residual developer on the photosensitive body 40, i.e., the waste developer, should be totally removed therefrom.

Figure 2:
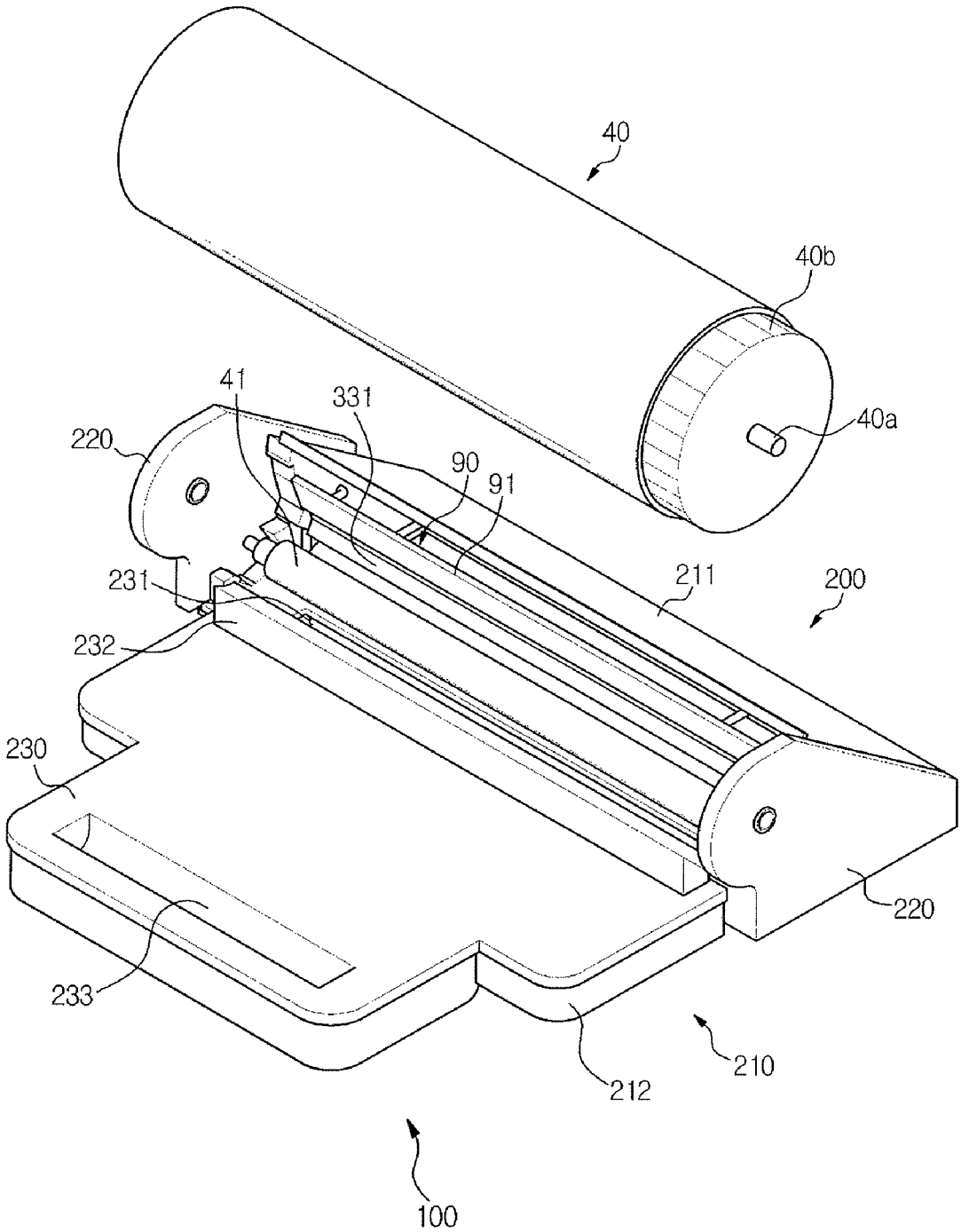
FIG. 2 is a perspective view illustrating a photosensitive body, a cleaning device and a developer storage device of the image forming apparatus according to FIG. 1.
Figure 3:
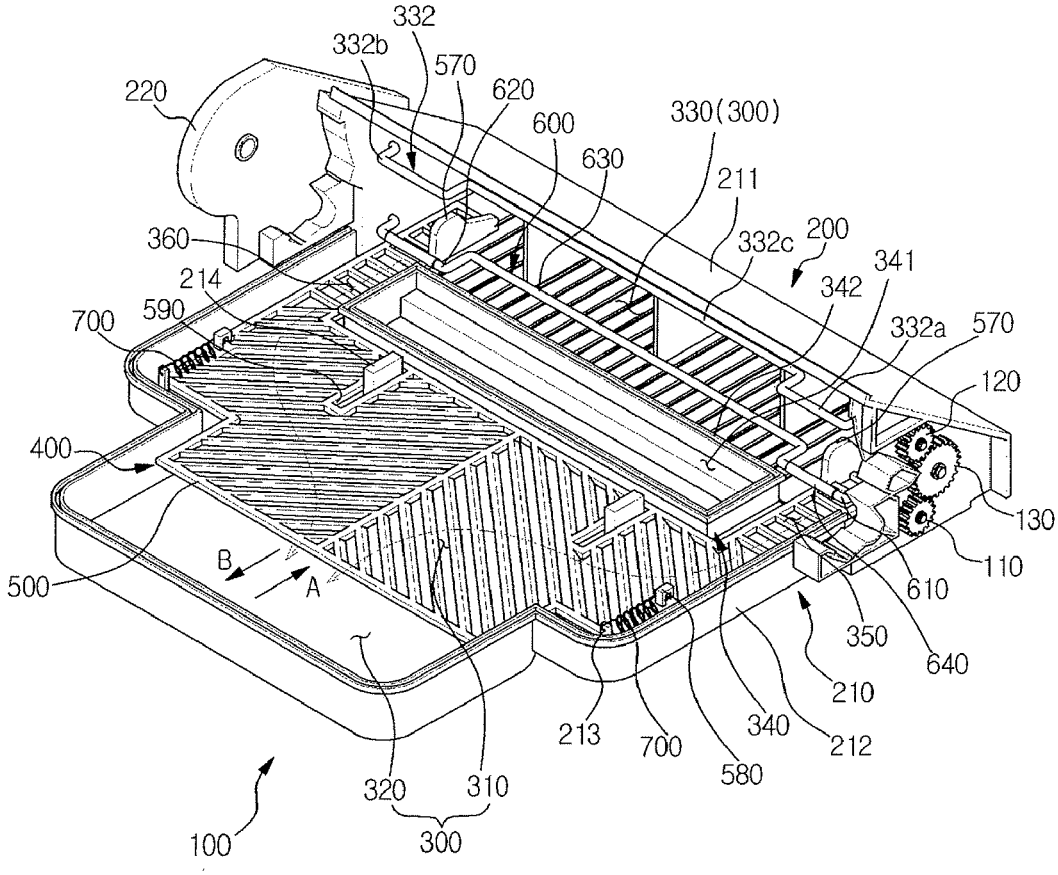
FIG. 3 is a perspective view illustrating an inner constitution of the developer storage device according to FIG. 2.

FIG. 2 is a perspective view illustrating the photosensitive body 40, a cleaning device 90 and the developer storage device 100 of the image forming apparatus 1 according to an exemplary embodiment of the present general inventive concept, and FIG. 3 is a perspective view illustrating an inner constitution of the developer storage device 100 according to an exemplary embodiment of the present general inventive concept.

As illustrated in FIGS. 2 and 3, the image forming apparatus 1 includes the cleaning device 90 to remove a residual developer on the photosensitive body 40, and the aforementioned developer storage device 100 to store the developer collected from the photosensitive body 40.

The cleaning device 90 includes a cleaning blade 91, which is mounted to contact the photosensitive body 40 at one side thereof in order to remove residual developer from the surface of the photosensitive body 40. The developer removed by the cleaning blade 91 is stored in the developer storage device 100. Although FIGS. 2 and 3 illustrate that the cleaning blade 91 is used in the cleaning device 90, a brush type cleaning device, roller type cleaning device, or any other type of cleaning device well known in the art may be used.

The developer storage device 100 includes the aforementioned housing 200, a developer storage part 300 provided inside the housing 200, and a developer conveying unit 400 to convey the developer stored in the developer storage part 300.

The housing 200 includes a main frame 210, side frames 220 and a cover 230, so as to define the developer storage part 300 thereinside.

The developer storage part 300 includes a first storage part 310 and a second storage part 320, which may have differing widths. The developer stored in the developer storage part 300 is conveyed to the second storage part 320 from the first storage part 310. In the embodiment of FIGS. 2 and 3, the first storage part 310 and the second storage part 320 are arranged to have symmetry in a width direction ("W" direction). That is, the first storage part 310 and the second storage part 320 are arranged such that a center portion in the width direction of the second storage part 320 coincides with a center portion in the width direction of the first storage part 310 as illustrated in FIG. 3.

The first storage part 310 may be designed to have a relatively large width, and the second storage part 320 may be designed to have a width smaller than the first storage part 310. The second storage part 320 may be designed to have a width smaller than the first storage part 310 in order to avoid interference with other components mounted near the developer storage device 100, and to efficiently utilize an inner space of the main body 10. The second storage part 320 may be formed to have a thickness larger than the first storage part 310 in response to the second storage part 320 having a width smaller than the width of the first storage part 310.

The developer storage part 300 may further include a third storage part 330, in which the developer to be conveyed to the first storage part 310 is stored.

A light window 340 is provided between the third storage part 330 and the second storage part 320. Developer paths 350 and 360 are respectively provided on both side portions of the light window 340. The light window 340 permits the light scanned from the laser scanning unit 30 to pass through the housing 200 and to reach the photosensitive body 40. The developer stored in the third storage part 330 travels along the developer paths 350 and 360 to move to the first storage part 310 while avoiding the light window 340.

The light window 340 includes a light-transmitting hole 341 formed at the bottom of the main frame 210, and a side wall 342 protruded upward from the periphery of the light-transmitting hole 341. The side wall 342 prevents the developer stored in the housing 200 from being introduced into the light-transmitting hole 341.

The developer paths 350 and 360 are provided on both side portions of the side wall 342, and are extended along both side surfaces of the side wall 342.

The cover 230 is disposed above the main frame 210, and covers the first storage part 310 and the second storage part 320 of the developer storage part 300, as well as the developer paths 350 and 360.

The cover 230 includes a light-transmitting hole 231 and a protruding wall 232 extending upward from the rear of the light-transmitting hole 231. The light having passed through the light window 340 of the main frame 210 can penetrate the cover 230 through the light-transmitting hole 231. The protruding wall 232 prevents the developer scattering from the developing devices 50Y, 50M, 50C and 50K disposed above the cover 230 from being introduced into the light-transmitting hole 341.

The cover 230 has a knob part 233, which is concavely formed at a rear portion of the cover 230. When a user installs or uninstalls the developer storage device 100, the knob part 233 enables a user to easily grasp the developer storage device 100.

The developer conveying unit 400 includes a first developer conveying member 500, a second developer conveying member 600, and an elastic member 700 to elastically bias the first developer conveying member 500 in one direction. The elastic member may be a spring, a piston, or any other type of elastic member well-known in the art.

The first developer conveying member 500 performs a rectilinear or reciprocal motion in the developer storage part 300, and conveys the developer stored in the first storage part 310 to the second storage part 320 in a diagonal direction. This allows the developer in the first storage part 310 to move smoothly into the second storage part 320, which has a width different from the first storage part 310.

The second developer conveying member 600 drives the first developer conveying member 500, and also agitates the developer stored in the third storage part 330. The second developer conveying member 600 is mounted to perform a rotating motion in the third storage part 330. However, the second developer conveying member 600 may be designed to perform a rectilinear or reciprocal motion as needed.

The main frame 210 includes a first frame part 211 which is protruded upward and forms the third storage part 330 thereinside, and a second frame part 212 which is extended in a longitudinal direction and forms the first storage part 310 and the second storage part 320 thereinside.

The side frames 220 are respectively coupled to both side surfaces of the first frame part 211, and a center shaft 40*a* of the photosensitive body 40 is rotatably supported by the side frames 220. A photosensitive body gear 40*b* is mounted to one end portion of the photosensitive body 40, and the photosensitive body gear 40*b* is engaged with a photosensitive body driving gear (not illustrated) mounted in the main body 10.

A rear portion of the third storage part 330 is opened, and a partition wall 331 is mounted to the opened portion of the third storage part 330. The cleaning blade 91 is supported by one side portion of the partition wall 331.

The aforementioned second developer conveying member 600 and a rotating member 332 are counted inside the third storage part 330 in an up and/or down direction. The second developer conveying member 600 and the rotating member 332 are rotated in the developer storage part 300, so as to agitate the developer stored in the third storage part 330 to prevent clumping of the developer.

The second developer conveying member 600 has first eccentric shaft portions 610 and 620 which are eccentric in a first direction with respect to a rotational center, and a second eccentric shaft portion 630 which is eccentric in a second direction. The first eccentric shaft portions 610 and 620 are respectively disposed on both side edge portions of the developer storage part 300, and the second eccentric shaft portion 630 is disposed between the first eccentric shaft portions 610 and 620.

Similar to the second developer conveying member 600, the rotating member 332 has first eccentric shaft portions 332*a* and 332*b* and a second eccentric shaft portion 332*c*.

A first gear 110 and a second gear 120 are mounted to the side surface of the first frame part 211 of the main frame 210, to transmit a rotational force to the second developer conveying member 600 and the rotating member 332. The first gear 110 is coaxially coupled to a rotating shaft of the second developer conveying member 600, and the second gear 120 is coaxially coupled to a end portion of the rotating member 332. A connecting gear 130 is mounted between the first gear 110 and the second gear 120. The first gear 110 is rotatably engaged with a rotating member driving gear (not illustrated) mounted in the main body 10, and the second gear 120 can be rotated by receiving power from the first gear 110 through the connecting gear 130.

Figure 4:
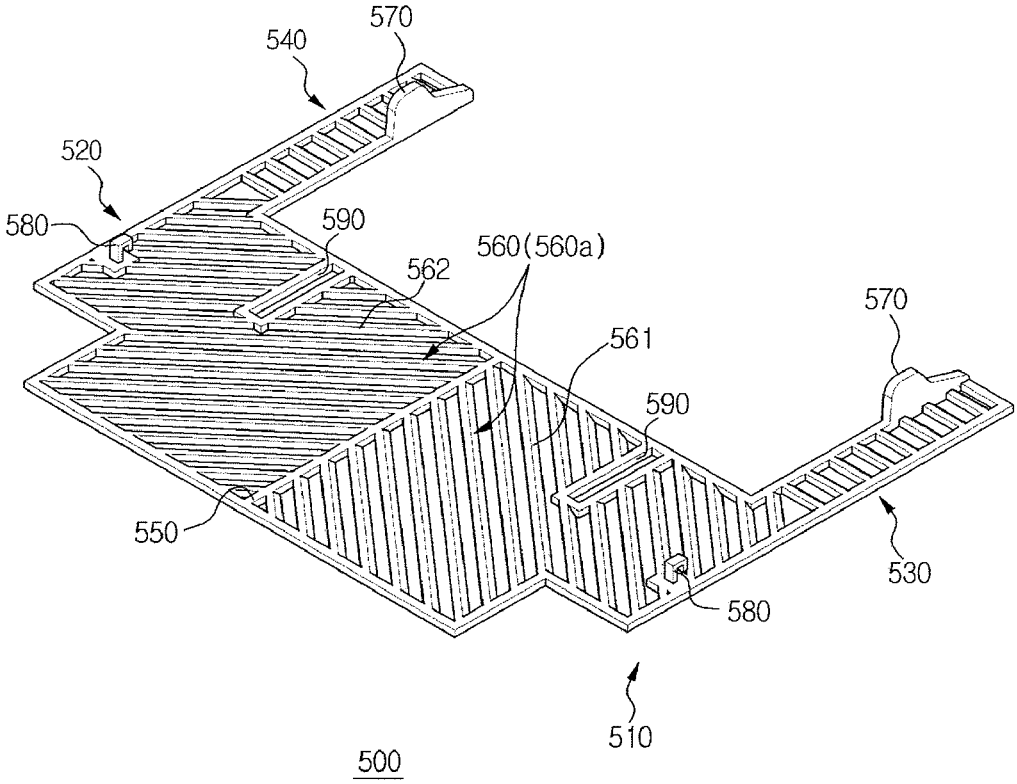
FIG. 4 is a perspective view illustrating a first developer conveying member of the developer storage device according to FIG. 2.
Figure 5:
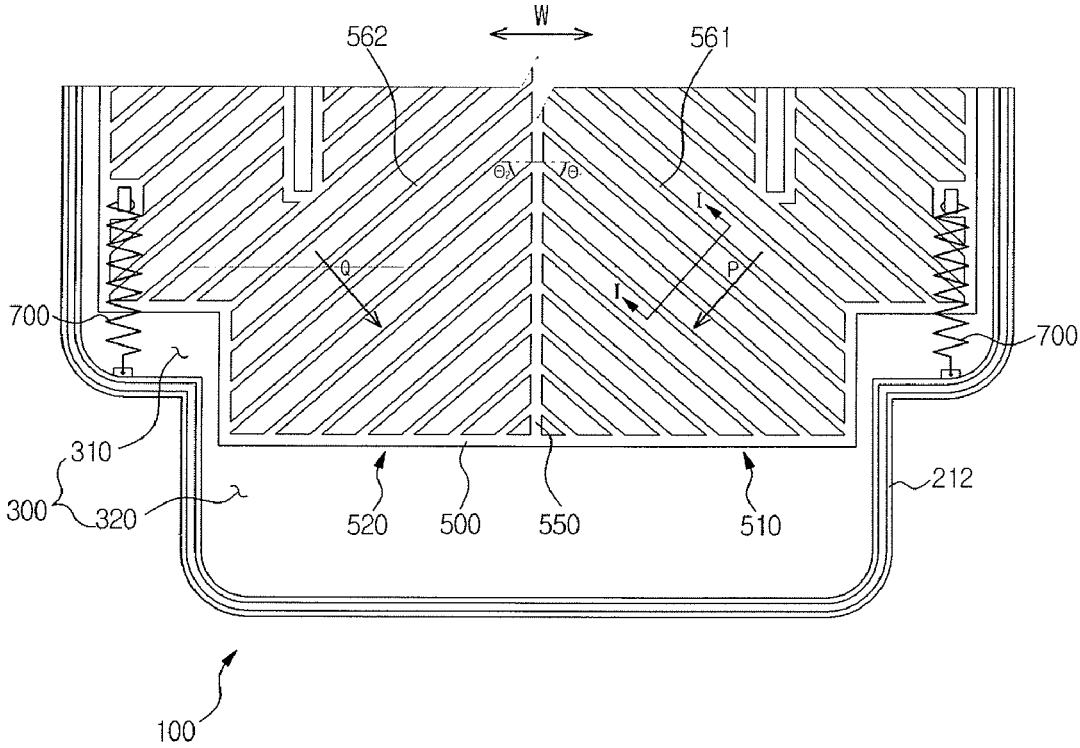
FIG. 5 is a plan view illustrating portions of a developer storage part and the first developer conveying member of the developer storage device according to FIG. 2.

FIG. 4 is a perspective view illustrating the first developer conveying member 500 of the developer storage device 100 according to an exemplary embodiment of the present general inventive concept, and FIG. 5 is a plan view illustrating portions of the developer storage part and the first developer conveying member 500.

As illustrated in FIGS. 3 through 5, the first developer conveying member 500 is formed in a plate shape, and is mounted within the developer storage device 100 to perform a rectilinear motion or a reciprocating motion including a linear trajectory in the housing 200.

The first developer conveying member 500 includes a first conveying part 510 and a second conveying part 520, which are both disposed within the first storage part 310 and the second storage part 320 of the developer storage part 300. The first developer conveying member 500 further includes a third conveying part 530 and a fourth conveying part 540 which are respectively extended toward the first storage part 310 through the developer paths 350 and 360 on both side edge portions of the third storage part 330.

The third conveying part 530 conveys the developer stored in the third storage part 330 to the first storage part 310 through the developer path 350 formed on a first side portion of the light window 340, and the fourth conveying part 540 conveys the developer stored in the third storage part 330 to the first storage part 310 through the developer path 360 formed on the a second side portion of the light window 340. The second side portion of the light window 340 may be opposite to the first side portion of the light window 340.

The first conveying part 510 and the second conveying part 520 are arranged symmetrically and parallel to each other with respect to a partition part 550, in a width direction of the developer storage part 300. The first conveying part 510 conveys the developer stored in the first storage part 310 of the developer storage part 300 to a center portion of the second storage part 320 in a first diagonal direction (i.e., a "P" direction, as illustrated in FIG. 5). The second conveying part 520 conveys the developer stored in the first storage part 310 of the developer storage part 300 to a center portion of the second storage part 320 in a second diagonal direction (i.e., a "Q" direction, as illustrated in FIG. 5).

In order to convey the developer in the first or second diagonal directions P or Q, the first developer conveying member 500 includes conveying elements 560 which are extended slantingly with respect to the width direction (i.e., a "W" direction as illustrated in FIG. 5) of the developer storage part 300. The conveying elements 560 may be configured as conveying ribs 560*a* which are arranged apart from each other in the developer conveying direction.

The arrangement pattern of the conveying ribs 560*a* and the slant angle of the conveying ribs 560*a* in relation to the width direction of the developer storage part 300 are determined by relative positions of the first storage part 310 and the second storage part 320. In the embodiment of FIG. 5, since the first storage part 310 and the second storage part 320 are arranged such that a center portion in the width direction of the second storage part 320 substantially coincides with a center portion in the width direction of the first storage part 310, first conveying ribs 561 of the first conveying part 510 and second conveying ribs 562 of the second conveying part 520 are formed symmetrically to each other. Also, a slant angle $\theta_1$ of the first conveying ribs 561 of the first conveying part 510 in relation to the width direction of the developer storage part 300 is set to be equal to a slant angle $\theta_2$ of the second conveying ribs 562 of the second conveying part 520 in relation to the width direction of the developer storage part 300.

Figure 6A:
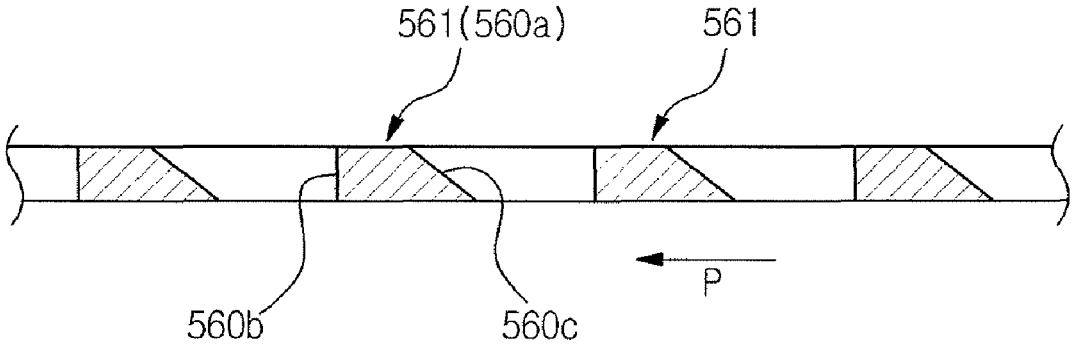
FIGS. 6A through 6C are views illustrating sections of conveying ribs taken along line "I-I" in FIG. 5.
Figure 6B:
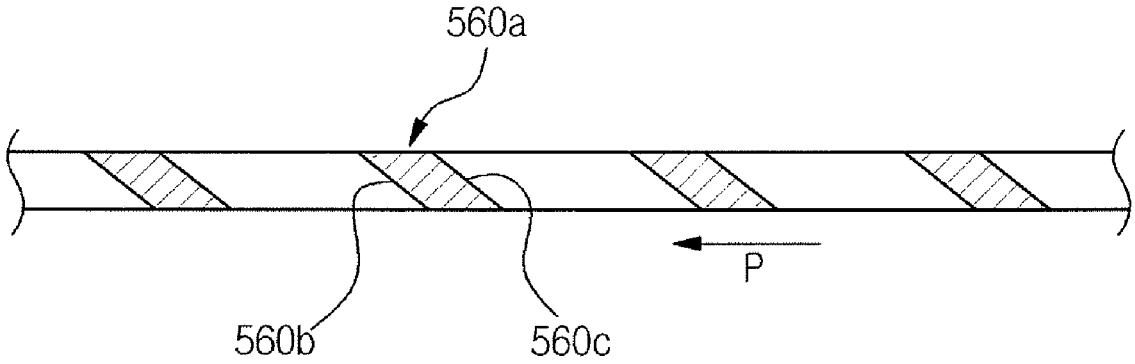
Figure 6C:
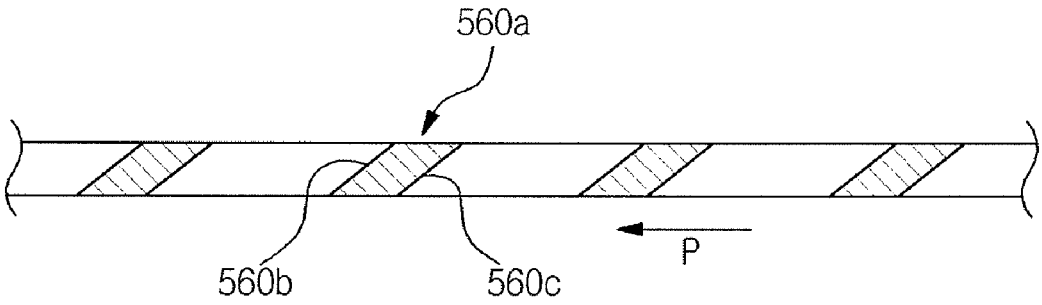

FIGS. 6A through 6C are views illustrating sections of the conveying ribs taken along line "I-I" in FIG. 5. As illustrated in FIG. 6A, a first side surface 560*b* of each conveying rib, which is directed in the developer conveying direction ("P" direction), may be formed to be a vertical surface so as to effectively convey the developer. A second side surface 560*c* of each conveying rib, which is positioned opposite to the first side surface 560*b*, may be formed in a slanted surface to minimize a potential backward movement of the developer when the conveying ribs 560*a* are moved in the direction opposite to the developer conveying direction.

As illustrated in FIG. 6B, the first side surface 560*b* of each conveying rib 560*a*, which is directed in the developer conveying direction ("P" direction), may be formed such that an upper portion is positioned more forward than a lower portion in the developer conveying direction (i.e., each conveying rib 560*a* may be formed to be slanted from left top to right bottom as illustrated in FIG. 6B). Such a shape of the conveying ribs 560*a* is adequate in a structure in which the second storage part 320 is formed to be deeper than the first storage part 310 in a downward direction. Since the first side surface 560*b* of each conveying rib 560*a* is slanted downward, the developer can be effectively conveyed in a downward direction, which is adequate in a structure in which the second storage part 320 is formed to be deeper than the first storage part 310 in the downward direction. The second side surface 560*c* of each conveying rib 560*a*, which is positioned opposite to the first side surface 560*b*, may be formed as a slanted surface to minimize the backward movement of the developer when the conveying ribs 560*a* are moved in the direction opposite to the developer conveying direction.

As illustrated in FIG. 6C, the first side surface 560*b* of each conveying rib 560*a*, which is directed in the developer conveying direction (i.e., a "P" direction as illustrated in FIG. 6C), may be formed such that an upper portion is positioned to be more backward than a lower portion in the developer conveying direction (i.e., may be formed to be slanted from right top to left bottom in the drawing). Such a shape of the conveying ribs 560*a* is adequate in a structure in which the second storage part 320 is formed to be deeper than the first storage part 310 in an upward direction. The second side surface 560*c* of each conveying rib, which is positioned opposite to the first side surface 560*b*, may be formed parallel to the first side surface 560*b* or formed to be a vertical surface.

The structure as illustrated in FIG. 6A may create a problem of non-smooth flow of resin in injection molding of the conveying ribs 560*a*, because of a non-uniform thickness of the conveying ribs 560*a*. Accordingly, structures the conveying ribs 560*a* as illustrated in FIG. 6B or 6C solve the potential non-smooth flow of resin problem exiting in the structures of the conveying ribs 560*a* as illustrated in FIG. 6A.

Referring to FIGS. 3 and 4, interference portions 570 are respectively provided at an end portion of the third conveying part 530 and an end portion of the fourth conveying part 540 of the first developer conveying member 500. The interference portions 570 are disposed so as to interfere with the first eccentric shaft portions 610 and 620 of the rotating second developer conveying member 600. If the interference portions 570 interfere with the rotating first eccentric shaft portions 610 and 620, the interference portions 570 are pushed by the first eccentric shaft portions 610 and 620, and thus the first developer conveying member 500 is moved in an "A" direction.

The first eccentric shaft portions 610 and 620 of the second developer conveying member 600 are mounted with shock-absorbing members 640. The shock-absorbing members 640 absorb shock generated when the rotating first eccentric shaft portions 610 and 620 collide with the interference portions 570, thereby preventing damage of the components.

The first conveying part 510 and the second conveying part 520 of the first developer conveying member 500 are provided with first elastic member mounting portions 580, and the main frame 210 are provided with second elastic member mounting portions 213 corresponding to the first elastic member mounting portions 580.

An elastic member 700 is mounted between each of the first elastic member mounting portions 580 and each of the second elastic member mounting portions 213 in such a manner that a first end of the elastic member 700 is supported by the first elastic member mounting portion 580 a second other end of the elastic member 700 is supported by the second elastic member mounting portion 213. The elastic member 700 elastically biases the first developer conveying member 500 in a direction opposite to the A direction (i.e., in a "B" direction as illustrated in FIG. 3).

If the first eccentric shaft portions 610 and 620 move away from the interference portions 570 of the first developer conveying member 500 as the second developer conveying member 600 rotates, the first developer conveying member 500 moves in the "B" direction by an elastic force of the elastic member 700. Accordingly, the developer stored in the third storage part 330 of the developer storage part 300 is conveyed to the first storage part 310 through the developer paths 350 and 360, and the developer stored in the first storage part 310 is conveyed to the center portion of the second storage part 320 in the diagonal direction.

If the developer is successively conveyed to the second storage part 320 and is filled over a predetermined level in the second storage part 320, a load applied to the first developer conveying member 500 due to the developer filled in the second storage part 320 becomes larger than the elastic force of the elastic member 700. Then, the first developer conveying member 500 cannot be moved in the "B" direction any more, and stops its operation.

If the operation of the first developer conveying member 500 is stopped, the developer stored in the third storage part 330 cannot be conveyed to the first storage part 310, and the developer collected from the photosensitive body 40 is stored in the third storage part 330. At this time, the second developer conveying member 600 and the rotating member 332 disposed in the third storage part 330 agitate the developer stored in the third storage part 330 to prevent clumping of the developer.

The main frame 210 has guide protrusions 214, and the first developer conveying member 500 has guide slots 590, through which the guide protrusions 214 are respectively inserted. The guide protrusions 214 and the guide slots 590 serve to assist the smooth rectilinear motion or reciprocating motion of the first developer conveying member 500. The guide protrusions 214 and the guide slots 590 are formed along a direction in which the developer is supposed to be conveyed, so that the developer can be conveyed in a desired direction by the rectilinear or reciprocating motion of the first developer conveying member 500.

Figure 7:
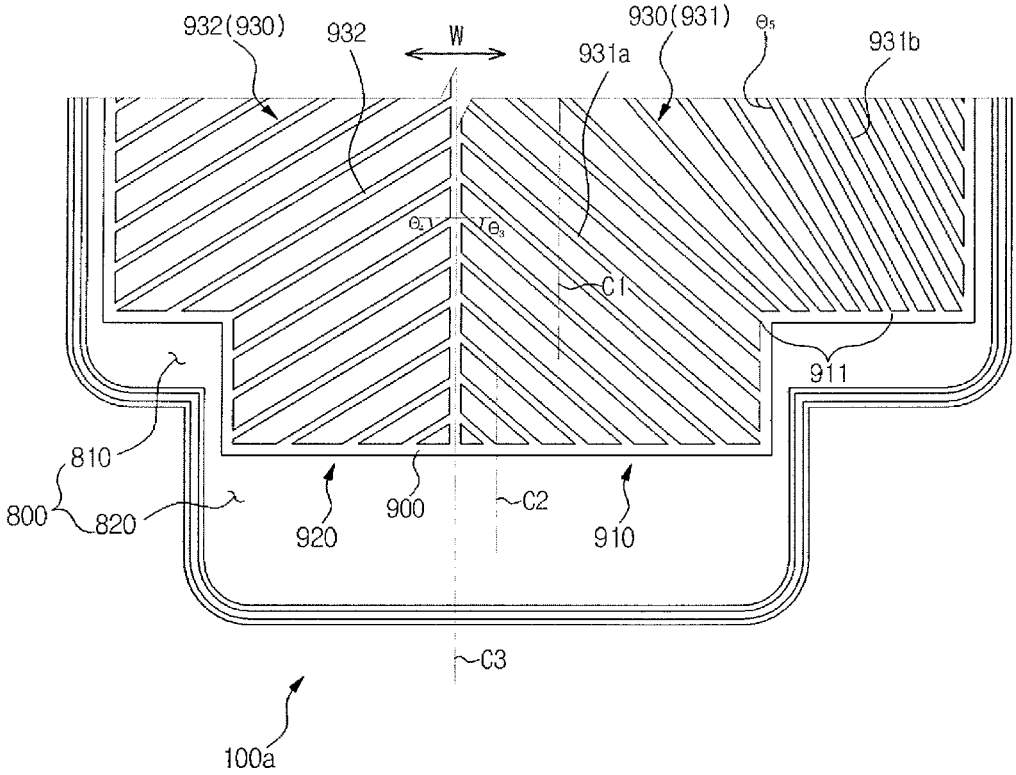
FIG. 7 is a plan view illustrating a developer storage device according to another embodiment of the present general inventive concept.

FIG. 7 is a plan view illustrating a developer storage device 100*a* according to another embodiment of the present general inventive concept.

As illustrated in FIG. 7, the developer storage device 100*a* includes a developer storage part 800 to store a developer, and a developer conveying member 900 to convey the developer by performing a reciprocating motion in the developer storage part 800.

The developer storage part 800 includes a first storage part 810 and a second storage part 820, which have differing widths. The first storage part 810 may be formed to have a relatively large width, and the second storage part 820 may be formed to have a width smaller than the first storage part 810. The developer stored in the first storage part 810 is conveyed to the second storage part 820 by the developer conveying member 900.

The developer conveying member 900 includes a first conveying part 910 and a second conveying part 920, which are arranged parallel to each other in a width direction (i.e., a "W" direction as illustrated in FIG. 7) of the developer storage part 800. The first conveying part 910 and the second conveying part 920 convey the developer stored in the first storage part 810 to the second storage part 820 in a diagonal direction.

The first conveying part 910 and the second conveying part 920 include conveying ribs 930 as elements to convey the developer. The conveying ribs 930 are extended slantingly with respect to the width direction of the developer storage part 800 so as to convey the developer in the diagonal direction.

In the embodiment of FIG. 7, the second storage part 820 is formed at a biased position in the width direction with respect to the first storage part 810. That is, a center portion in the width direction of the second storage part 820 is located at a deviated position from a center portion in the width direction of the first storage part 810. FIG. 7 illustrates that the center portion of the second storage part 820 is located at a position deviated to the left from the center portion of the first storage part 810. In order to visibly illustrate that the center portion of the second storage part 820 is located at a position deviated to the left from the center portion of the first storage part 810, a center line C1 of the first storage part 810 and a center line C2 of the second storage part 820 are illustrated in FIG. 7.

As such, if the second storage part 820 is formed at a biased position in the width direction with respect to the first storage part 810, the developer conveying member 900 should be designed to convey the relatively large amount of developer in the biased direction of the second storage part 820. In the embodiment of FIG. 7 in which the second storage part 820 is formed at a position biased to the left, the developer conveying member 900 is designed such that the first conveying part 910 to convey the developer to the left can effectively convey the larger amount of developer than the second conveying part 920.

To achieve this, a boundary line C3 between the first conveying part 910 and the second conveying part 920 is positioned near the center line C2 of the second storage part 920. First conveying ribs 931 of the first storage part 910 include conveying ribs 931*a* which are arranged at a slant angle larger than second conveying ribs 932 of the second conveying part 920 with respect to the width direction ("W" direction) of the developer storage part 800. That is, a slant angle $\theta_3$ ($\theta_3$ is an acute angle) of at least some first conveying ribs 931 of the first conveying part 910 from the width direction of the developer storage part 800 is set to be different from a slant angle $\theta_4$ (i.e., $\theta_4$ is an acute angle) of the conveying ribs 932 of the second conveying part 920 from the width direction of the developer storage part 800. More particularly, in order to effectively convey the developer in the C3 direction, the angle $\theta_3$ should be larger than the angle $\theta_4$.

The first conveying ribs 931 of the first conveying part 910 may further include conveying ribs 931*b* which are arranged at a slant angle $\theta_5$ (i.e., $\theta_5$ is an acute angle) which is larger than the angle $\theta_3$. The first conveying part 910 may further include an arrangement angle changing portion 911 in which the arrangement angle of the conveying ribs is gradually changed from $\theta_5$ to $\theta_3$.

The conveying ribs 931*b* arranged at the relatively large angle $\theta_5$ are positioned at the upstream side of the first storage part 810 with respect to the developer conveying direction. This is because it is needed to more effectively convey the developer in the width direction at the upstream side of the first storage part 810 which is relatively distant from the center portion of the second storage part 820 in the width direction.

The above embodiments have described the constitution in which a developer storage device stores the waste developer collected from a photosensitive body, however the present general inventive concept is not limited to such a constitution.

For example, the developer storage device according to the present general inventive concept may store a new developer to be supplied to the photosensitive body. In such a case, the developer storage device may be formed integrally with a developing device which supplies a toner to the photosensitive body.

Also, the present general inventive concept is not limited to a constitution in which the developer storage device stores waste developer collected from the photosensitive body, and can also be applied to a constitution in which the developer storage device stores the waste developer collected from other image carriers. For example, the present general inventive concept can be applied to the developer storage device which stores the waste developer collected from an intermediate transfer belt, as illustrated in FIG. 1.

As apparent from the above description, the image forming apparatus according to the present general inventive concept can evenly store the developer in the developer storage device by conveying the developer in a direction adequate in the structure of the developer storage device which is determined properly depending on the inner structure of the image forming apparatus. Accordingly, an inner space of the image forming apparatus and the inner space of the developer storage device can be efficiently utilized. As a result, the image forming apparatus can be manufactured compactly.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. A developer storage device, comprising:

a developer storage part including a first storage part and a second storage part having widths different from each other; and a first developer conveying member to convey a developer stored in the first storage part to the second storage part in a diagonal direction, wherein the first developer conveying member includes conveying elements extended slantingly with respect to a width direction of the developer storage part, and a angle between the conveying elements and the width direction of the developer storage part is determined depending on relative positions of the first storage part and the second storage part.

2. The developer storage device according to claim 1, wherein the first developer conveying member is sectioned into at least two parts in the width direction of the developer storage part, and the conveying elements are arranged to have symmetry in the at least two parts.

3. The developer storage device according to claim 1, wherein the second storage part is disposed at a biased position in the width direction with respect to the first storage part.

4. The developer storage device according to claim 3, wherein:

the first developer conveying member is sectioned into at least two parts in the width direction of the developer storage part; and the conveying elements provided in one part of the first developer conveying member include conveying elements extended slantingly at an angle larger than the conveying elements provided in the other part of the first developer conveying member with respect to the width direction of the developer storage part.

5. The developer storage device according to claim 1, wherein the first developer conveying member further includes an arrangement angle changing portion in which an angle of the conveying elements extended slantingly is changed.

6. The developer storage device according to claim 1, wherein:

the first developer conveying member includes a first conveying part to convey a developer to a center portion of the second storage part in a first direction; and a second conveying part to convey a developer to the center portion of the second storage part in a second direction.

7. The developer storage device according to claim 6, wherein the first conveying part and the second conveying part are arranged parallel to each other in a width direction of the developer storage part.

8. The developer storage device according to claim 7, wherein the center portion of the second storage part is located at a deviated position from a center portion of the first storage part in the width direction.

9. The developer storage device according to claim 8, wherein the first conveying part conveys the larger amount of developer than the second conveying part.

10. The developer storage device according to claim 6, wherein the first conveying part and the second conveying part are arranged such that a boundary line therebetween is positioned near the center portion of the second storage part.

11. The developer storage device according to claim 1, wherein the second storage part has a width smaller than the first storage part.

12. The developer storage device according to claim 1, wherein the developer storage part stores a waste developer.

13. The developer storage device according to claim 1, wherein the first developer conveying member is formed in a plate shape, and conveys a developer by a reciprocating motion in the developer storage part.

14. The developer storage device according to claim 13, wherein:

the first developer conveying member includes a guide part to guide the motion thereof; and the guide part is formed along a direction in which a developer is to be conveyed.

15. The developer storage device according to claim 1, wherein the conveying elements include conveying ribs arranged apart from each other in a developer conveying direction.

16. The developer storage device according to claim 15, wherein each of the conveying ribs includes slanted surfaces which are slanted with respect to the developer conveying direction.

17. The developer storage device according to claim 16, wherein each of the conveying ribs includes a vertical surface directed in the developer conveying direction and a slanted surface positioned opposite to the vertical surface.

18. The developer storage device according to claim 1, wherein the developer storage part further includes a third storage part to store a developer to be conveyed to the first storage part, and a developer path to connect the third storage part and the first storage part.

19. The developer storage device according to claim 18, wherein a part of the first developer conveying member is disposed in the developer path.

20. The developer storage device according to claim 18, further comprising:

a second developer conveying member disposed in the third storage part.

21. The developer storage device according to claim 20, wherein the first developer conveying member is operated interlockingly with the second developer conveying member.

22. The developer storage device according to claim 21, wherein the second developer conveying member performs a rotating motion, and the first developer conveying member performs a rectilinear motion.

23. An image forming apparatus, comprising:

an image carrier; and a developer storage device to store a new developer to be supplied to the image carrier or a waste developer collected from the image carrier, comprising:

a developer storage part including a first storage part and a second storage part having widths different from each other, and a developer conveying member to convey a developer stored in the first storage part to the second storage part by a reciprocating motion in the developer storage part, and wherein the developer conveying member includes conveying ribs extended in a diagonal direction with respect to a width direction of the developer storage part, the developer conveying member is sectioned into a first part and a second part in the width direction of the developer storage part, and the first storage part and the second storage part are arranged such that a center portion of the second storage part is located at a deviated position from a center portion of the first storage part in the width direction.

24. The image forming apparatus according to claim 23, wherein the conveying ribs provided in the first part and the conveying ribs provided in the second part are arranged to have symmetry to each other.

25. The image forming apparatus according to claim 23, wherein:

the conveying ribs are arranged in the first part and the second part so as to convey a developer to the center portion of the second storage part in different directions from each other; and an angle ($\theta_3$, which is an acute angle) between at least some of the conveying ribs arranged in the first part and the width direction of the developer storage part is larger than an angle ($\theta_4$, which is an acute angle) between the conveying ribs arranged in the second part and the width direction of the developer storage part.

26. A developer conveying member usable with a developer storage device, comprising:

first and second conveying parts disposed adjacent to each other in a first direction and having a plurality of first and second ribs, respectively, extending from a boundary of the first and second conveying parts in first and second directions at an acute angle with respect to a conveying direction of the developer, wherein the plurality of first and second ribs extend from the boundary of the first and second conveying parts to form a planar shape.

27. The developer conveying member of claim 26, further comprising:

third and fourth conveying parts having narrower widths than the first and second conveying parts to convey the developer to the first and second conveying parts.

28. An image forming apparatus, comprising:

a developer storage device comprising a plurality of developer storage parts, such that a waste developer is accumulated in a first of the plurality of developer storage parts before accumulating in a second of the plurality of the developer storage parts; and a conveying member to first convey the waste developer from the second of the plurality of the developer storage parts to the first of the plurality of developer storage parts, wherein the conveying member comprises:

a plurality of conveying ribs extended in a diagonal direction with respect to a width direction of the developer storage device, and the plurality of conveying ribs is divided by a center portion of the conveying member to extend a first portion of the plurality of conveying ribs in a first diagonal direction and to extend a second portion of the plurality of conveying ribs in a second diagonal direction.

29. The image forming apparatus of claim 28, wherein the plurality of developer storage parts each have differing widths.

30. The image forming apparatus of claim 29, wherein the width of the first developer storage part is smaller than the width of the second developer storage part.

31. The image forming apparatus of claim 28, wherein the conveying member moves in a reciprocating motion with respect to the first of the plurality of developer storage parts to transfer the developer thereto.

32. The image forming apparatus of claim 28, wherein an angle of the first portion of the plurality of conveying ribs with respect to the center portion of the conveying member decreases as the first portion of the plurality of conveying ribs move away from the center portion of the conveying member.

33. An image forming apparatus, comprising:

a plurality of developer storage parts to store waste developer therein; and a conveying member to convey the waste developer a first of the plurality of developer storage parts to another of the plurality of the developer storage parts, the conveying member comprising:

a plurality of conveying ribs extending from a center portion of the conveying member at acute angles to convey the waste developer from, and an arrangement angle changing portion to decrease the acute angles of the conveying ribs as the conveying ribs move away from the center portion of the conveying member.

* * * * *